US010697616B2

(12) United States Patent
Vang et al.

(10) Patent No.: US 10,697,616 B2
(45) Date of Patent: Jun. 30, 2020

(54) LUMINAIRE WITH MOUNTING BRACKET AND REMOVABLE OPTIC COUPLED TO HOUSING

(71) Applicant: Hubbell Incorporated, Shelton, CT (US)

(72) Inventors: Seng Vang, Piedmont, SC (US); Randy Lewis, Greenville, SC (US); Thomas Holscher, Simpsonville, SC (US); Jessica Merck, Lyman, SC (US); Dave Hunter, Greer, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/401,895

(22) Filed: May 2, 2019

(65) Prior Publication Data

US 2019/0338924 A1 Nov. 7, 2019

Related U.S. Application Data

(60) Provisional application No. 62/745,499, filed on Oct. 15, 2018, provisional application No. 62/665,804, filed on May 2, 2018.

(51) Int. Cl.
*F21V 17/00* (2006.01)
*F21S 8/02* (2006.01)
(Continued)

(52) U.S. Cl.
CPC ..... *F21V 17/00* (2013.01); *F21S 4/28* (2016.01); *F21S 8/026* (2013.01); *F21V 3/02* (2013.01);
(Continued)

(58) Field of Classification Search
CPC .... F21Y 2115/10; F21V 17/00; F21V 23/001; F21V 23/002; F21V 23/004;
(Continued)

(56) References Cited

U.S. PATENT DOCUMENTS 5,477,441 A 12/1995 Budnovitch et al.
6,994,452 B2 2/2006 Rozenberg
(Continued)

OTHER PUBLICATIONS

PCT/US2019/030427 International Search Report and Written Opinion dated Sep. 3, 2019 (13 pages).

*Primary Examiner* — Robert J May
(74) *Attorney, Agent, or Firm* — Michael Best & Friedrich, LLP

(57) ABSTRACT

A luminaire includes a housing having a pair of sides and a base extending between the sides. A lens is removably coupled to the housing and includes side portions. A mounting bracket is directly coupled to the base and includes a chamber, and a driver is coupled to the base and positioned within the chamber. A plurality of light emitters is coupled to a surface of the mounting bracket and in communication with the driver. A first portion includes a pocket and a protuberance positioned on one of a side portion of the lens and a side of the housing. A second portion includes a projection and a curved portion positioned on the other of the side portion of the lens and the side of the housing. The protuberance is engageable with the pocket to couple the lens to the housing.

21 Claims, 20 Drawing Sheets

(51) Int. Cl.

| | |
|---|---|
| ***F21S 4/28*** | (2016.01) |
| ***F21V 15/015*** | (2006.01) |
| ***F21V 21/005*** | (2006.01) |
| ***F21V 23/00*** | (2015.01) |
| ***F21V 3/02*** | (2006.01) |
| ***F21V 7/00*** | (2006.01) |
| ***F21V 23/04*** | (2006.01) |
| *F21Y 103/10* | (2016.01) |
| *F21Y 105/12* | (2016.01) |
| *F21Y 105/14* | (2016.01) |
| *F21Y 115/10* | (2016.01) |

(52) U.S. Cl.

CPC ..... *F21V 7/005* (2013.01); *F21V 15/015* (2013.01); *F21V 21/005* (2013.01); *F21V 23/007* (2013.01); *F21V 23/0442* (2013.01); *F21Y 2103/10* (2016.08); *F21Y 2105/12* (2016.08); *F21Y 2105/14* (2016.08); *F21Y 2115/10* (2016.08)

(58) Field of Classification Search

CPC .... F21V 23/005; F21V 23/006; F21V 23/007; F21V 23/008; F21V 23/009; F21V 17/164; F21S 4/00; F21S 4/10; F21S 4/15; F21S 4/20; F21S 4/22; F21S 4/24; F21S 4/26; F21S 4/28

See application file for complete search history.

(56) References Cited

U.S. PATENT DOCUMENTS

| | | | | |
|---|---|---|---|---|
| 7,267,461 | B2 * | 9/2007 | Kan | F21V 5/002 362/373 |
| 7,513,637 | B2 * | 4/2009 | Kelly | A47F 3/001 362/126 |
| 7,922,354 | B2 * | 4/2011 | Everhart | F21V 23/009 362/235 |
| 9,285,084 | B2 * | 3/2016 | Amrine, Jr. | F21V 3/02 |
| 2007/0041220 | A1 | 2/2007 | Lynch | |
| 2010/0195333 | A1 | 8/2010 | Schaefer et al. | |

* cited by examiner

LUMINAIRE WITH MOUNTING BRACKET AND REMOVABLE OPTIC COUPLED TO HOUSING

CROSS-REFERENCE TO RELATED APPLICATION

This application claims priority to U.S. Application No. 62/665,804, filed May 2, 2018, and to U.S. Application No. 62/745,499, filed Oct. 15, 2018 the entire contents of these are incorporated herein by reference.

BACKGROUND

The present disclosure relates to a luminaire, and more specifically to a luminaire housing supporting an optic such as a lens.

SUMMARY

In one independent aspect, a luminaire includes a housing including a pair of sides and a base extending between the sides; a lens removably coupled to the housing, the lens including side portions; a mounting bracket directly coupled to the base and including a chamber, a driver coupled to the base and positioned within the chamber; a plurality of light emitters coupled to a surface of the mounting bracket and in communication with the driver; a first portion including a pocket and a protuberance positioned on either a side portion of the lens or a side of the housing; and a second portion including a projection and a curved portion positioned on the other of the side portion of the lens and the side of the housing, the protuberance engageable with the pocket to couple the lens to the housing.

In another independent aspect, a luminaire includes a housing including a pair of sides having an S-shaped portion that includes a pocket and a protuberance; a mounting bracket coupled to the housing and supporting at least one light emitter; and a lens removably coupled to the housing, the lens including side portions having a portion including a projection and a curved portion, the curved portion engageable with the protuberance and the projection engageable with the pocket to create a snap-fit engagement.

In yet another independent aspect, a luminaire includes a housing including a base and a first side and a second side extending from the base; a mounting bracket directly coupled to the base and including a chamber, a driver coupled to the base within the chamber; a plurality of light emitters supported on a surface of the mounting bracket; an end cap coupled to the housing, the end cap configured to limit light emitted from the light emitters from passing through the end cap; and a lens removably coupled to the housing at a terminal end of the housing without the use of additional fastening members, the lens configured to at least partially cover the light emitter.

Other aspects of the disclosure will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to a lens that is removably coupled to a housing of a luminaire in order to selectively cover light emitters. The lens is coupled to the housing without the use fasteners.

Figure 1:
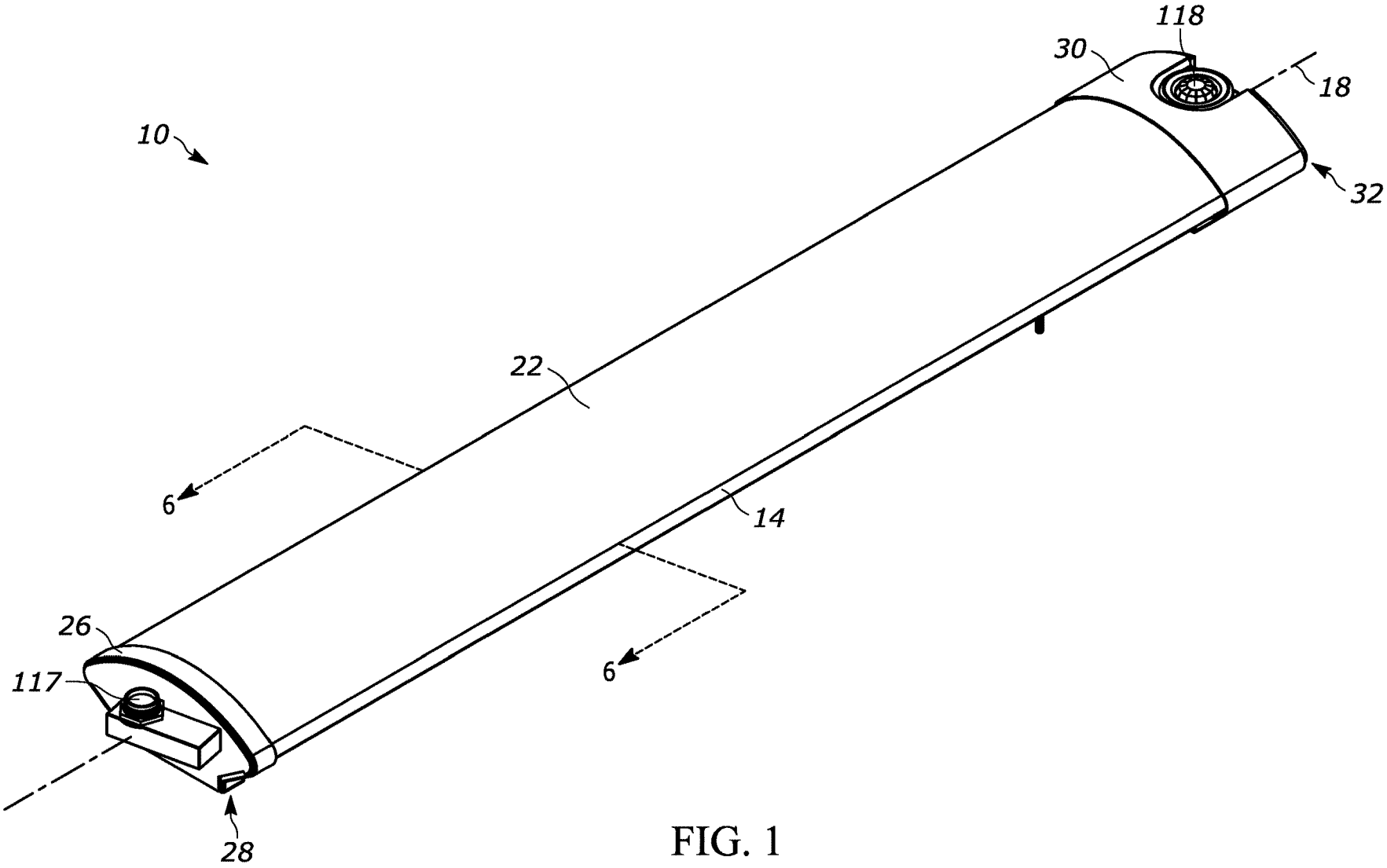
FIG. 1 is a perspective view of a luminaire.

As shown in FIG. 1, a luminaire 10 includes a housing 14 with an elongated body that extends along a longitudinal axis 18. A lens 22 is coupled to the housing 14. The lens 22 extends in a direction parallel to the axis 18 along a length of the housing 14. In the illustrated embodiment, a first end cap 26 is coupled to a first end 28 of the housing 14 and a second end cap 30 is coupled to a second end 32 of the housing 14. In the illustrated embodiment, the end caps 26, 30 define an end surface of the luminaire oriented orthogonal to the axis 18.

Figure 2:
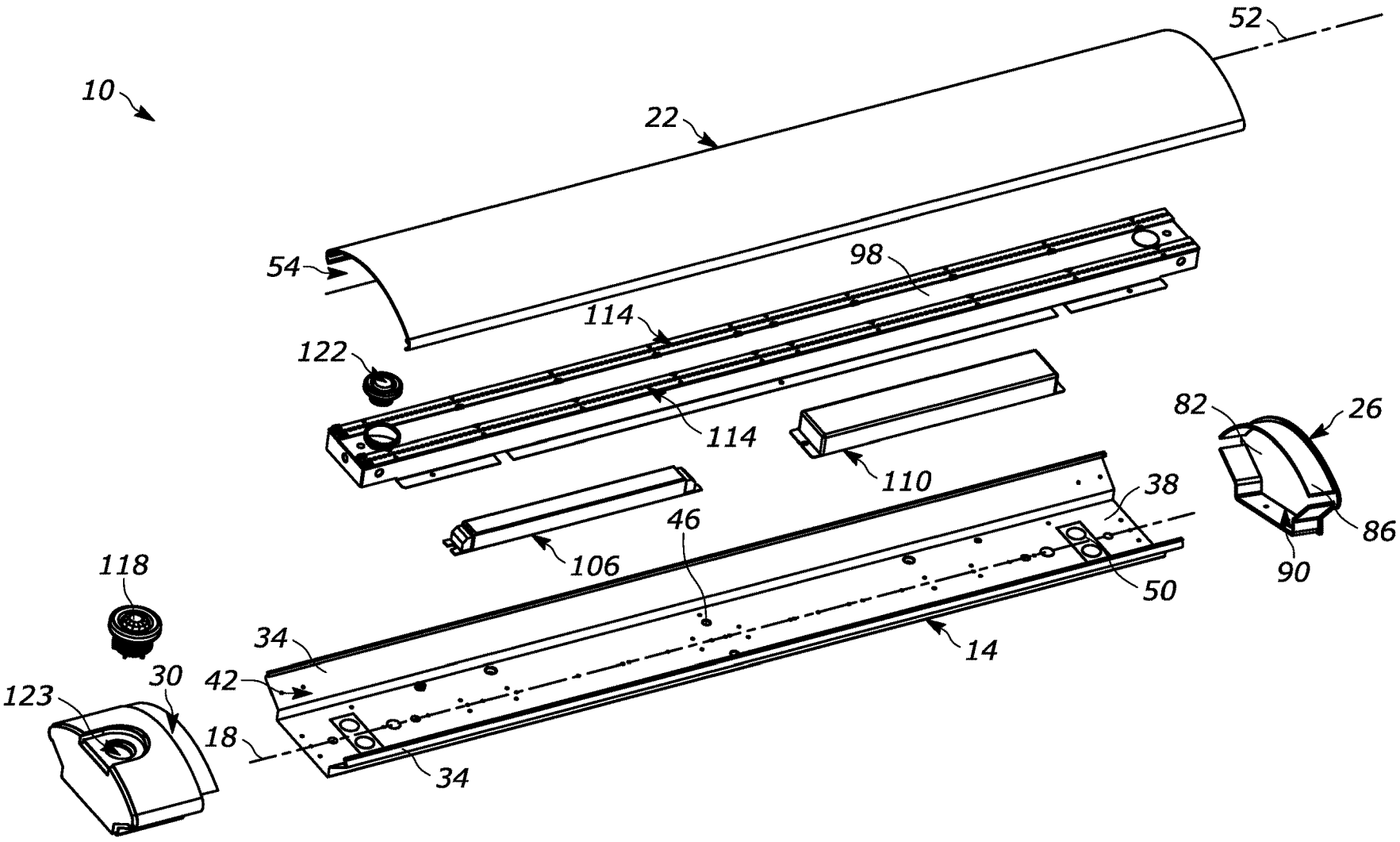
FIG. 2 is an exploded view of the luminaire of FIG. 1.
Figure 3:
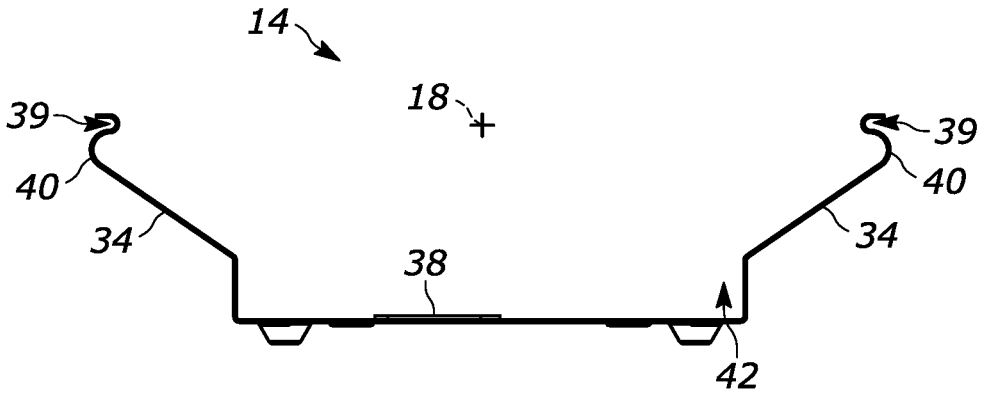
FIG. 3 is an end view of a housing of the luminaire of FIG. 1.

As shown in FIGS. 2 and 3, in the illustrated embodiment, the housing 14 has a somewhat V-shaped cross section, including two inclined side portions 34 and a base portion 38 that extends between the side portions 34. The base portion 38 can be secured to a support surface (e.g., a wall or ceiling). The V-shaped section forms a channel 42 that extends in a direction parallel to the axis 18. The housing 14 also includes apertures 46 and removable sections or knockouts 50 disposed along the base portion 38 and/or side portions 34. The apertures 46 permit communication (e.g., for wires) between an external environment and the channel 42 through a portion of the housing 14. Alternatively, or in addition to the apertures 46, he knockouts 50 can be detached from the housing 14 as desired to create apertures (not shown).

As shown in FIG. 3, in the illustrated embodiment, the side portions 34 are substantially linear and terminal ends of the side portions 34 include an S-shaped feature (i.e., a concave section adjacent a convex section). The S-shaped feature includes a pocket 39 and a protuberance 40. In the illustrated embodiment, the pocket 39 is disposed at the terminal end of the respective side portion 34 and opens away from the longitudinal axis 18. The pocket 39 also extends orthogonally with respect to the axis 18. In the illustrated embodiment, the protuberance 40 is disposed between the respective pocket 39 and the linear section of the side portion 34. The protuberances 40 protrude away from one another and away from the axis 18. In the illustrated embodiment, the protuberance 40 is larger than the pocket 39.

Figure 4:
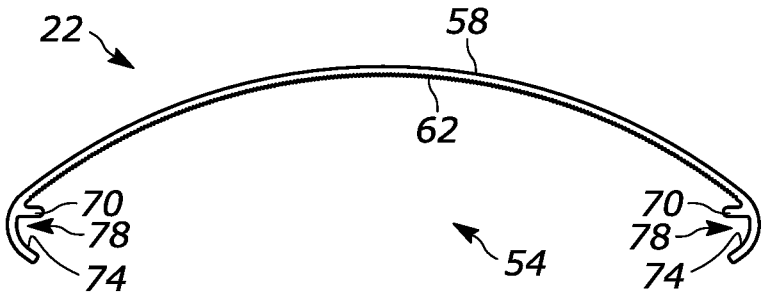
FIG. 4 is an end view of a lens of the luminaire of FIG. 1.

As shown in FIGS. 2 and 4, the lens 22 is open on three sides (e.g., a first end, a second end, and a bottom). In the illustrated embodiment, the lens 22 has a substantially curvilinear profile that extends at least partially around a longitudinal axis 52, and a passage 54 extends between the ends of the lens 22. In other embodiments, the lens 22 may have a substantially planar profile. An external surface 58 is disposed proximate the external environment, and an internal surface 62 faces inwardly, opposite the external surface 58 and proximate the passage 54. In the illustrated embodiment, the external surface 58 is substantially smooth and the internal surface 62 includes ridges (FIG. 4); in other embodiments, the external surface may have surface formations such as ridges, and/or the internal surface may be substantially smooth. Projections 70 protrude from the sides of the internal surface 62 into the passage 54. In the illustrated embodiment, the projections 70 are orthogonal with respect to the longitudinal axis 52. Curved portions 74 are positioned on either side of the passage 54 and a terminal end of each of the curved portions 74 slopes inwardly toward the longitudinal axis 52. Pockets 78 are formed on each side of the passage 54 along the surface of the curved portions 74 between the respective projection 70 and the terminal end of the curved portion 74. In the illustrated embodiment, the projections 70, curved portions 74, and pockets 78 form an E-shape. In some embodiments, the lens 22 may include an S-shaped feature and the side portions 34 may include an E-shaped feature.

Figure 5:
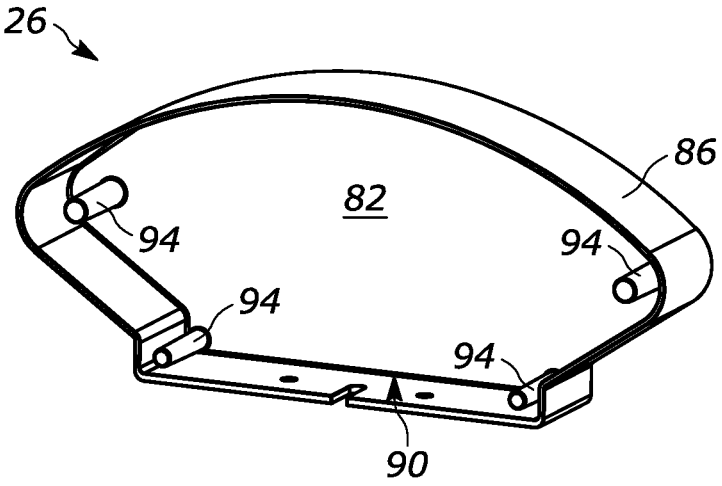
FIG. 5 is a perspective view of an end cap of the luminaire of FIG. 1.

As shown in FIGS. 2 and 5, the end caps 26, 30 has a main surface 82 with a profile substantially similar to a combined profile of the housing 14 coupled to the lens 22. In other words, the end caps 26, 30 inclined side portions formed between a rounded portion and a base surface. In the illustrated embodiment, each end cap 26, 30 also includes a side wall 86 extending along a perimeter of the end cap 26, 30 and oriented orthogonally relative the main surface 82. In the illustrated embodiment, the side wall 86 partially encloses a cavity 90 with the main surface 82 (FIG. 5).

As shown in FIG. 5, the end cap 26 includes projections 94. In the illustrated embodiment, the projections 94 are disposed within the cavity 90 and protrude from the main surface 82 in the same direction as the side wall 86. The projections 94 are spaced apart from one another. In the illustrated embodiment, the projections 94 are cylindrical in shape. The end cap 30 includes substantially similar projections (not shown).

Figure 6:
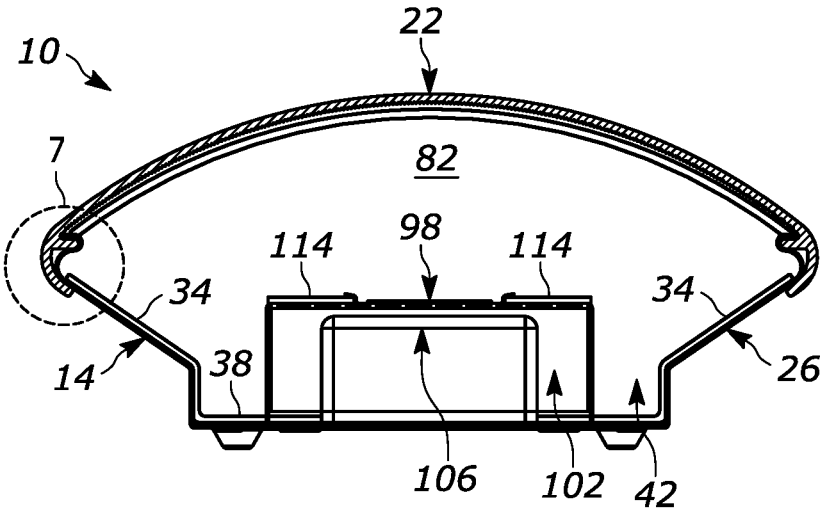
FIG. 6 is a cross-sectional view of the luminaire of FIG. 1, viewed along section 6-6.

Returning to FIG. 2, a mounting bracket 98 is coupled to the base portion 38 of the housing 14. In the illustrated embodiment, the mounting bracket 98 has a substantially rectangular profile and includes a hollow central portion that defines a chamber 102 (FIG. 6). Control drivers 106 (e.g., current drivers) and a power source 110 (e.g., a battery pack—FIG. 2) are coupled to the base portion 38 within the chamber 102. Light boards 114 containing light emitters (e.g., light emitting diodes or LEDs) are coupled to the mounting bracket 98 and configured to emit light in a direction outwardly and away from the chamber 102). The light boards 114 are in electrical communication with the control drivers 106 and the power source 110. In other embodiments, the light boards may be in electrical communication with an external power source (e.g., a wall outlet—not shown) either instead of, or in addition to, the power source 110. In the illustrated embodiment, the light boards 114 span a length of the mounting bracket 98. In other embodiments, the light boards may have a different length, and/or the luminaire may include fewer or more light boards.

Figure 7:
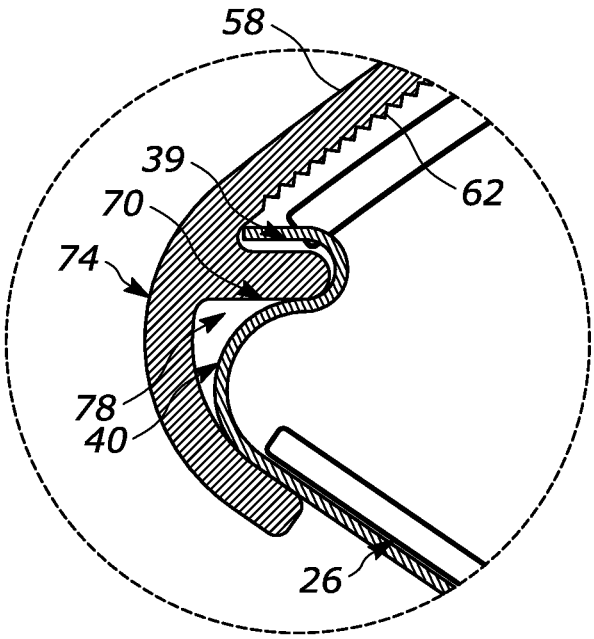
FIG. 7 is an enlarged view of portion 7-7 of the cross-sectional view of FIG. 6.
Figure 8:
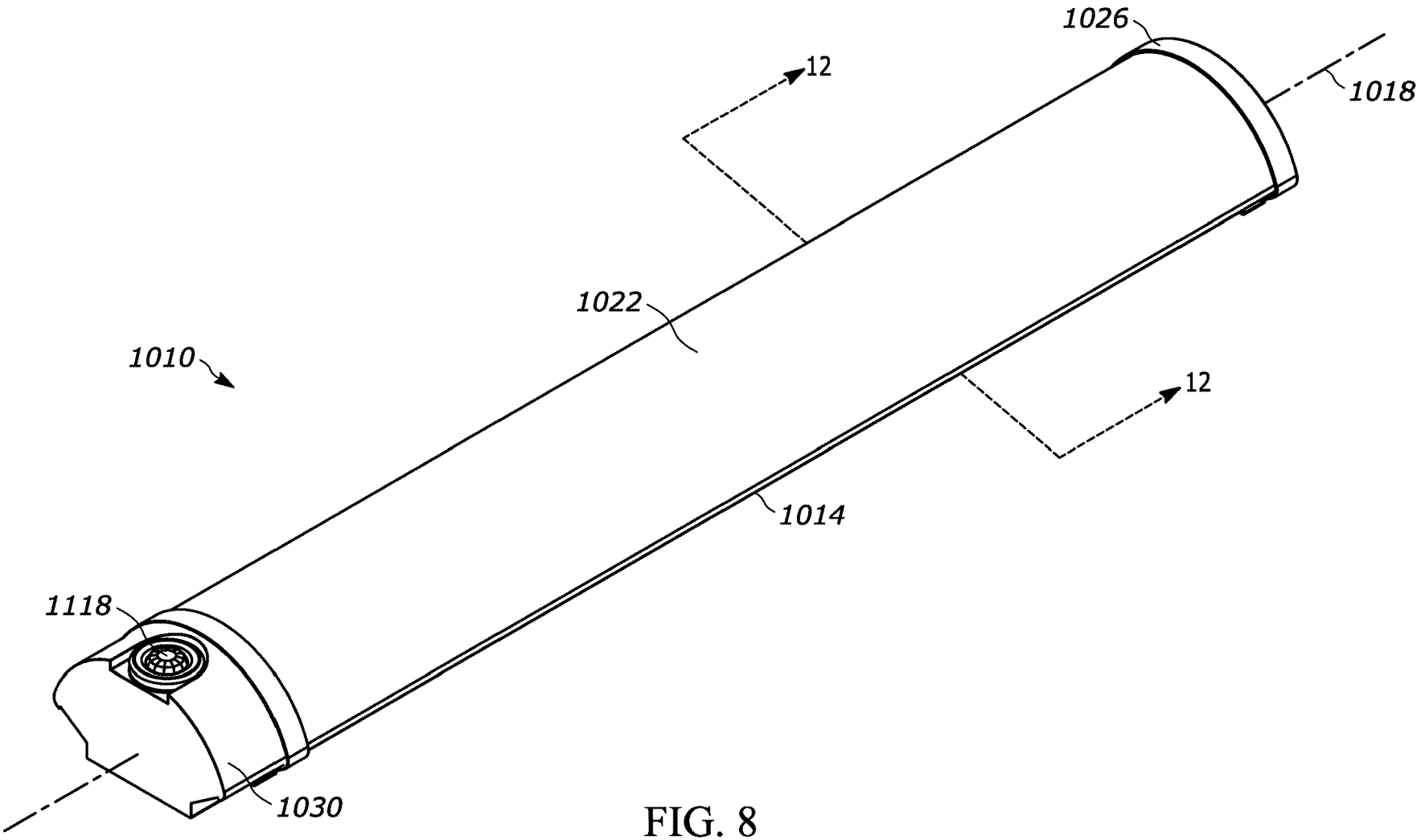
FIG. 8 is a perspective view of a luminaire according to another embodiment.
Figure 9:
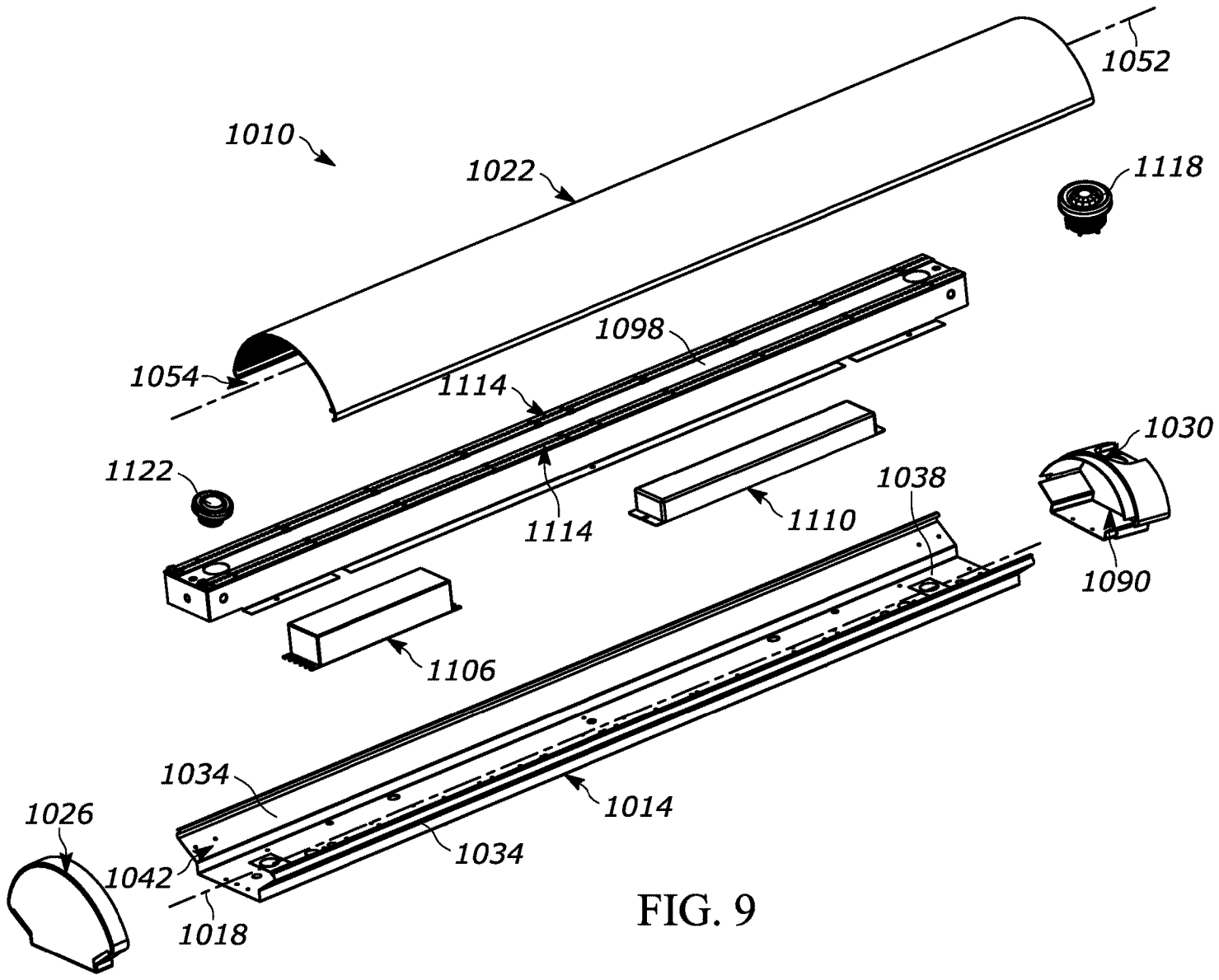
FIG. 9 is an exploded view of the luminaire of FIG. 8.
Figure 10:
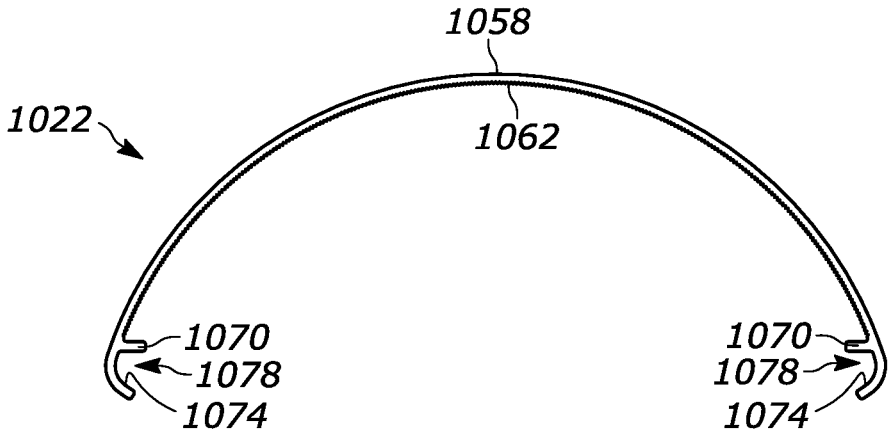
FIG. 10 is an end view of a lens of the luminaire of FIG. 8.
Figure 11:
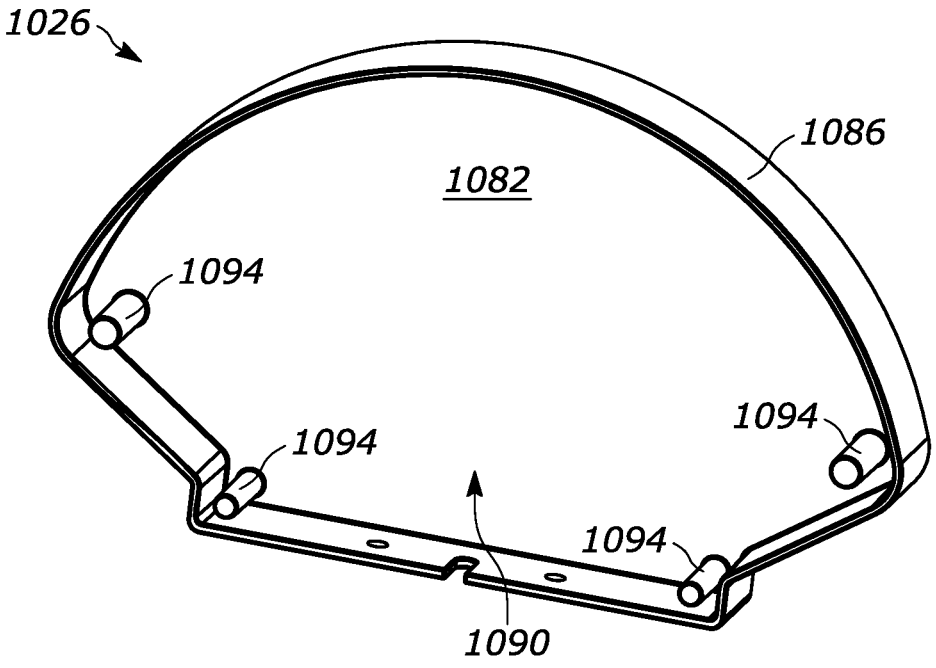
FIG. 11 is a perspective view of an end cap of the luminaire of FIG. 8.
Figure 12:
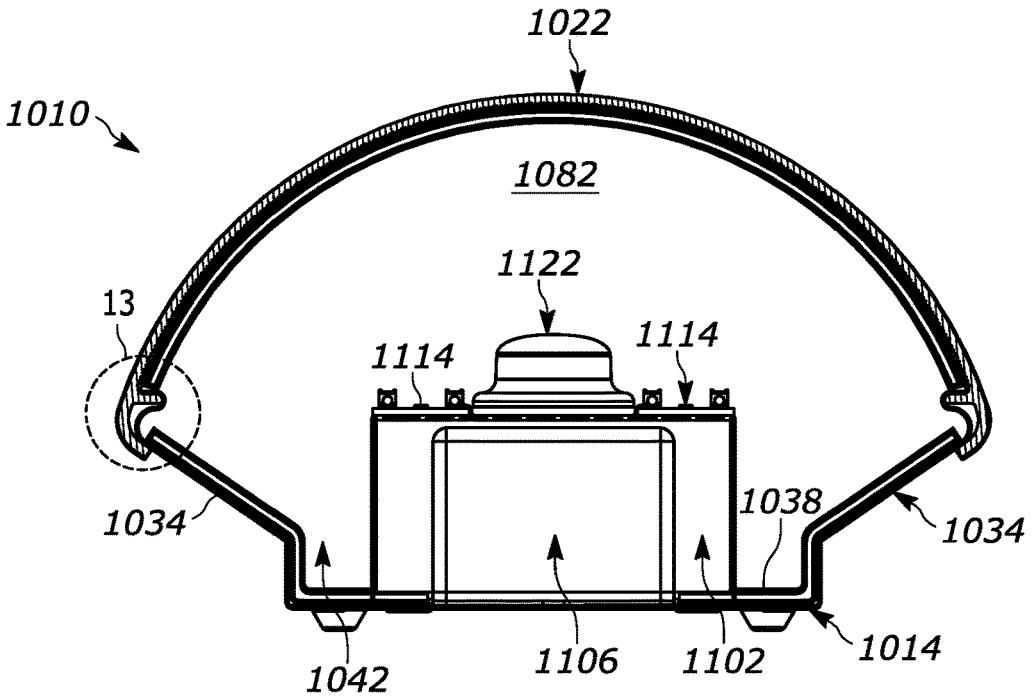
FIG. 12 is a cross-sectional view of the luminaire of FIG. 8, viewed along section 12-12.
Figure 13:
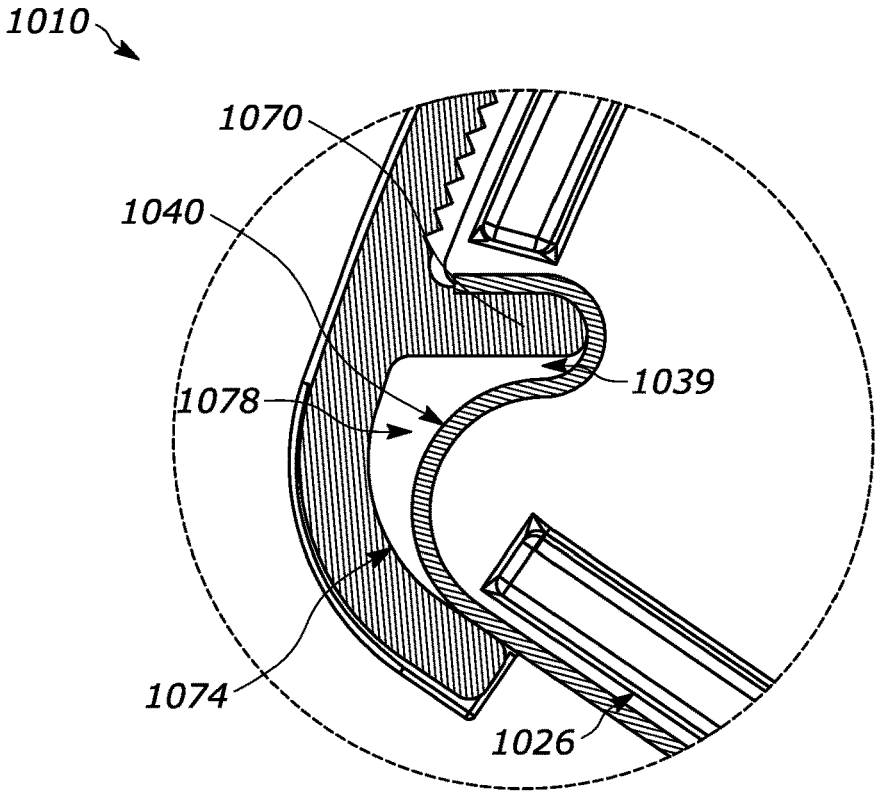
FIG. 13 is an enlarged view of portion 13-13 of the cross-sectional view of FIG. 12.
Figure 14:
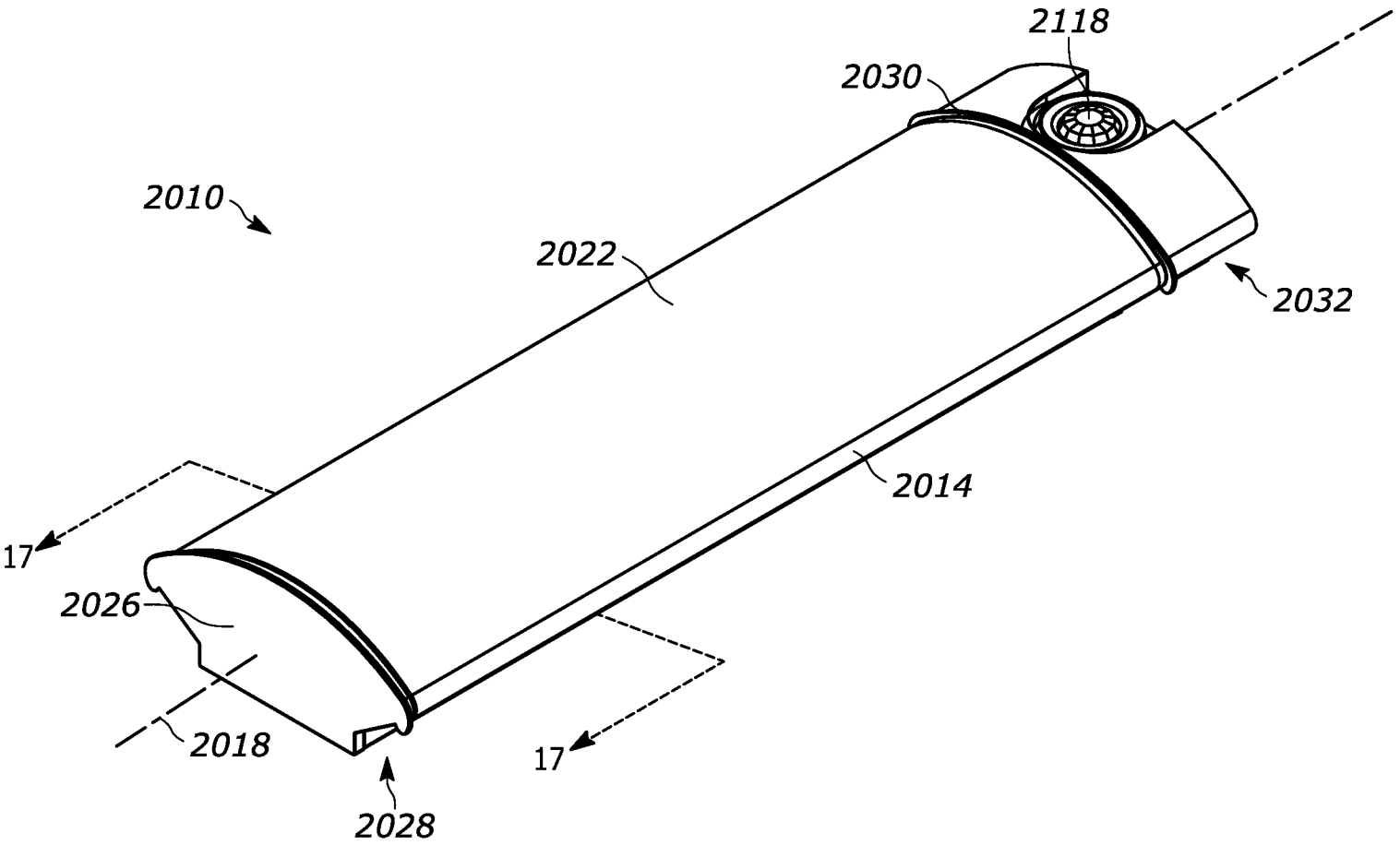
FIG. 14 is a perspective view of a luminaire according to another embodiment.

As shown in FIGS. 6 and 7, the lens 22 is coupled to the housing 14 so that the longitudinal axis 52 is parallel to the axis 18. The pockets 78 of the lens 22 are similar in shape to the protuberances 40 of the side portions 34, which allows one of the pockets 78 to engage or nest with an associated one of the protuberances 40. The lens 22 snaps onto the housing 14 in order to couple the two together. The pocket 78 receives the protuberance 40 so that a portion of the lens 22 wraps around the protuberance 40. The projections 70 abut upper portions of the protuberances 40 (e.g., portions of the side portions 34 that include both the pocket 39 and the protuberance 40) and the curved portions 74 abut lower surfaces of the protuberance 40 (e.g., transition areas of the side portions 34 between the linear section and the S-shaped section), thereby securing the protuberance 40 within the associated pocket 78. In the illustrated embodiment, the projections 70 include rounded edges, allowing the projections 70 to engage the protuberances 40. The curved portions 74 include a similar radius of curvature as the protuberances 40, allowing the curved portions 74 and the lower surfaces of the protuberances 40 to substantially mate (i.e., the curved portions 74 and the lower surfaces substantially contact each other along their length).

The projections 70 are also received within the pockets 39. In some embodiments, the rounded edges of the projections 70 have a similar radius of curvature to the associated pocket 78, allowing the projections 70 and surfaces of the pockets 39 to substantially mate (i.e., the projections 70 and the pockets 39 contact each other along their length).

Contact between the projections 70, the curved portions 74 and the respective surfaces of the protuberances 40 limit movement of the lens 22 relative to the housing 14 in directions that are non-parallel to the axis 18 (e.g., in a vertical direction as shown in FIG. 6). Contact between the pockets 39 and the projections 70 further limits movement of the lens 22 in directions that are non-parallel to the axis 18. In the illustrated embodiment, the nesting arrangement forces direct contact between the projections 70, the curved portions 74, and the respective surfaces of the protuberances 40 while the lens 22 is coupled to the housing 14. The nesting arrangement also forces direct contact between projections 70 and the pockets 39. The direct contact between these features 39, 40, 70, 74 provides a snap-fit.

The snap-fit between the lens 22 and the housing 14 facilitates quick coupling of the lens 22 and housing 14 together. Additionally, the snap-fit arrangement eliminates the need for tabs, lances, brackets and other connective hardware (not shown) required in conventional lens couplings. Eliminating connective hardware/features eliminates, or substantially reduces, dark spots and shadows caused by the connective hardware/features blocking light from exiting the lens. A user may also remove the lens 22 by applying a force proximate either curved portion 74 of the lens 22 to move the curved portion 74 away from the lower surface of the protuberance 40, thereby allowing the lens 22 to be separated from the housing 14.

Once the lens 22 is coupled to the housing 14, the end caps 26, 30 are coupled to the housing 14. In the illustrated embodiment, an outermost surface of the end caps 26, 30 is wider than the housing 14 and the lens 22 (i.e., along the side wall 86). The outermost surfaces of end caps 26, 30 slide over the housing 14 and the lens 22 so that ends of the housing 14 and lens 22 are received within the cavity 90 of the respective end cap 26, 30. The projections 94 are disposed on the main surface 82 a distance apart from the outermost surface, and are closer to the axis 18 than the side portions 34. The projections 94 slide along an inner surface of the side portions 34 (i.e., proximate the channel 42) when the cavity 90 receives the housing 14 and lens 22. Upper projections 94 slide against inner surfaces of the protuberances 40 (i.e., along a pocket adjacent the channel 42 that mirrors the shape of the protuberance 40) and lower projections 94 slide against an interface between the side portions 34 and the base portion 38. The projections 94 limit movement in directions that are non-parallel to the axis 18, while still allowing translational movement in one direction along the axis 18.

When the luminaire 10 is fully assembled, the control drivers 106 regulate current from the battery pack 110 (or the external power source) to the light board(s) 114. Current from the battery pack 110 causes the LEDs on the light board(s) 114 to output light. The lens 22 may be transparent or translucent and allow light to pass through. The side walls 86 of the end caps 26, 30 act as light seals and limit the emission of light proximate the ends of the lens 22. Additionally, the main surface 82 of the end caps 26, 30 is solid and prevents light from being emitted from the housing in a direction along the axis 18.

In the illustrated embodiment, the luminaire 10 also includes sensors 117 and 118 in communication with at least one module 122 (FIG. 2). The sensor 117 is disposed on the end cap 26 and sensor 118 is disposed in an opening 123 of the end cap 30. The sensors 117, 118 may be occupancy sensors, motion sensors, or ambient light sensors. The module 122 is coupled to the mounting bracket 98. In the illustrated embodiment, the sensors 117, 118 communicate with the module 122 through radio waves; although in other embodiments the sensor 118 and the module 122 may communicate via Bluetooth, Wi-Fi, or a wired connection. The module 122 is in communication with the drivers 106, so that a signal sensed by the sensors 117, 118 controls the light output from the light board(s) 114. The sensors 117, 118 may send signals to the drivers 106 via the module 122 to only provide current to the light board(s) 114 when movement is sensed in a given room. The sensors 117, 118 may also send a signal to the drivers 106 via the module 122 to output a different level of current based on an amount of light sensed that is not emitted from the luminaire 10 (e.g., natural light)

FIGS. 8-13 illustrate another embodiment of a luminaire 1010. Common elements include the same reference number, plus 1000. The luminaire 1010 is substantially similar to the luminaire 10, although the lens 1022 includes a smaller radius of curvature than the lens 22. Thus, the lens 1022 has a more rounded profile than the lens 22.

FIGS. 14-18 illustrate a further embodiment of a luminaire 2010. Common elements include the same the reference number, plus 2000. The luminaire 2010 is substantially similar to the luminaire 10, and only differences will be described below.

Figure 15:
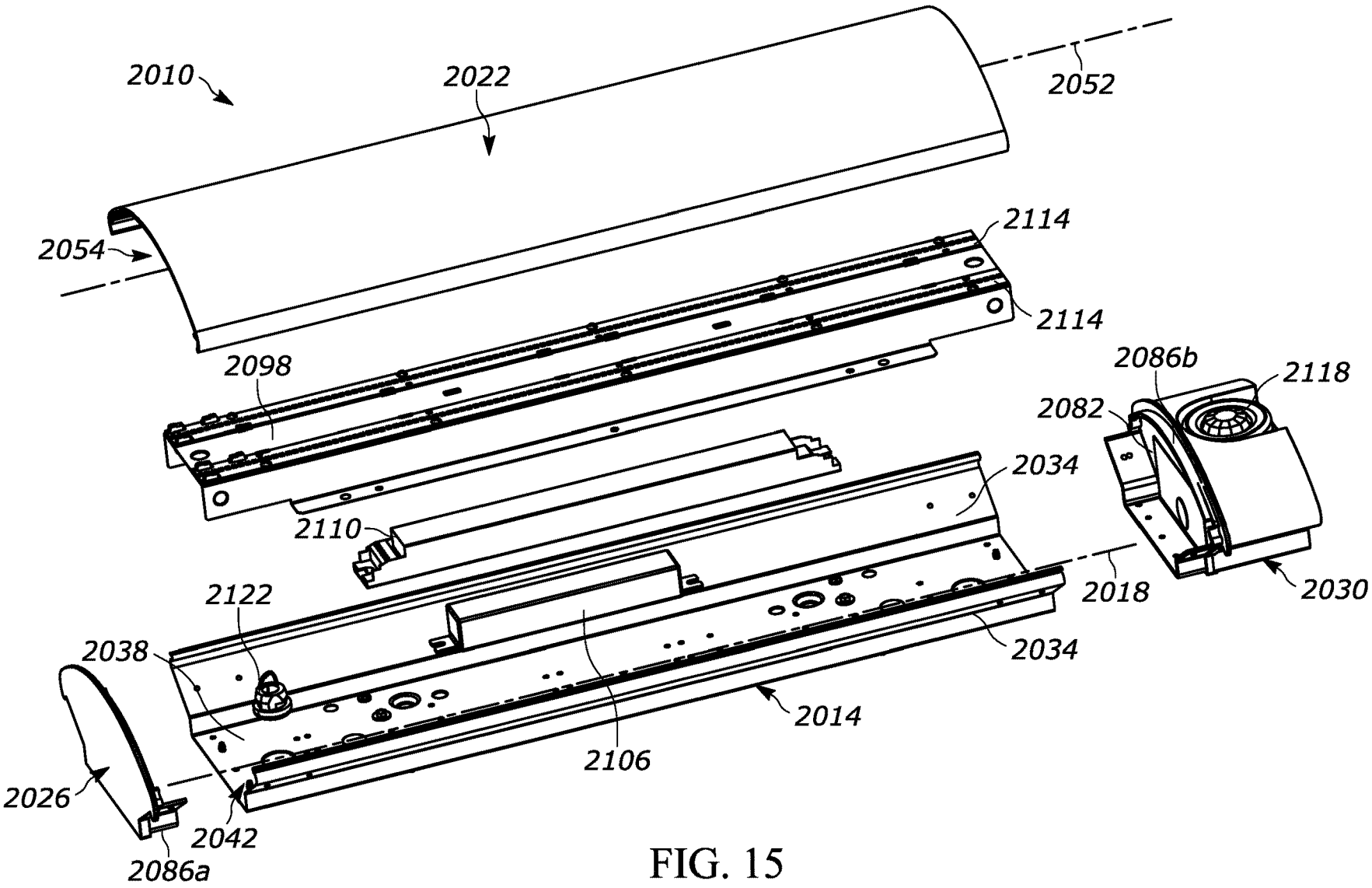
FIG. 15 is an exploded view of the luminaire of FIG. 14.
Figure 16:
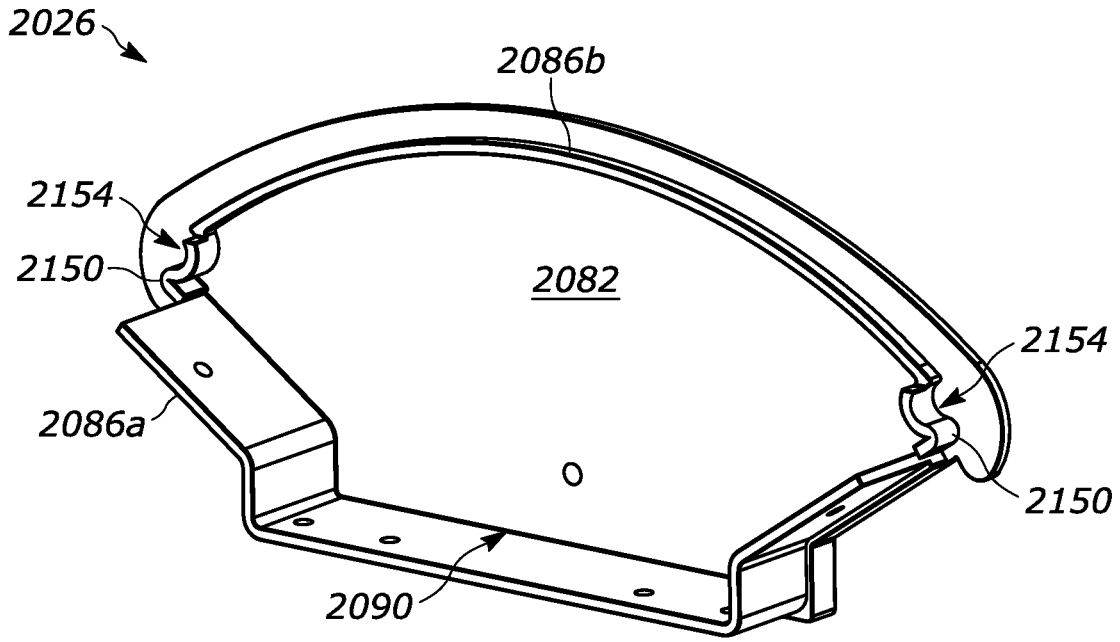
FIG. 16 is a perspective view of an end cap of the luminaire of FIG. 14.

As shown in FIGS. 15 and 16, the end caps 2026, 2030 have a main surface 2082 with a profile substantially similar to a combined profile of the housing 2014 coupled to the lens 2022. In the illustrated embodiment, each end cap 2026, 2030 also includes a side wall 2086 spaced apart from a peripheral edge of the end cap 2026, 2030. The side wall 2086 includes a first portion **2086*a* that is substantially similar in shape to the housing 2014, and a second portion 2086*b* that has a curved shape similar to the profile of the lens 2022. In the illustrated embodiment, a gap between the first side portion 2086*a* and the peripheral edge is less than a gap between the peripheral edge and the second side portion 2086*b*. The side wall 2086 is oriented orthogonally relative the main surface 2082. In the illustrated embodiment, the side wall 2086 forms a substantially enclosed shape on the main surface 2082 (FIG. 16**).

As shown in FIG. 16, the end cap 2026 includes protuberances 2150 and pockets 2154. In the illustrated embodiment, the protuberances 2150 and the pockets 2154 are formed as part of the second portion **2086*b*, and one protuberance 2150 and one pocket 2154 are positioned adjacent each side of the second portion 2086*b*. In the illustrated embodiment, each protuberance 2150 is shaped similarly to the protuberance 2040, and each pocket 2154 is shaped similarly to the pocket 2039. The end cap 2030** includes substantially similar projections (not shown).

Figure 17:
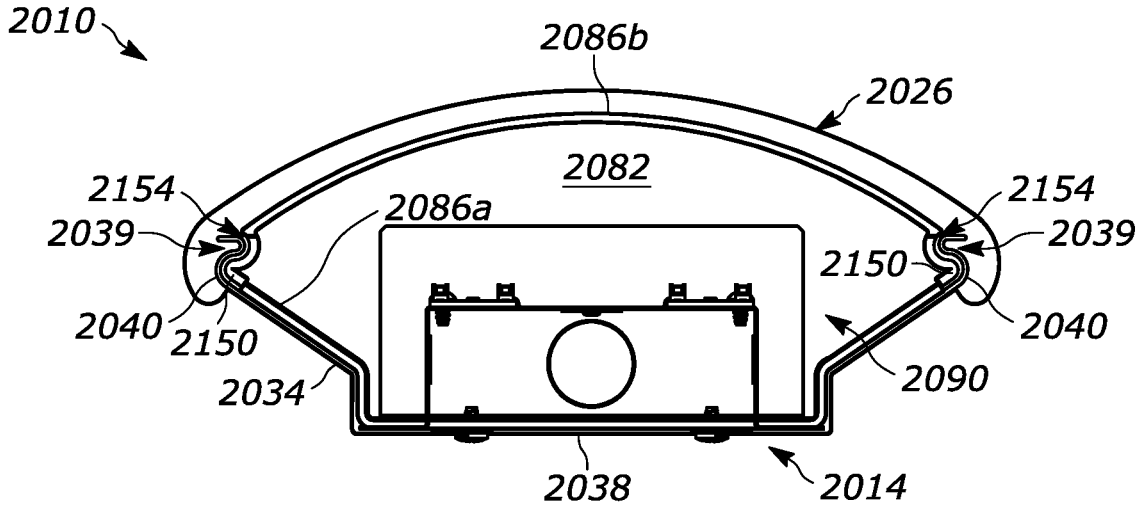
FIG. 17 is a cross-sectional view of the luminaire of FIG. 14, viewed along section 17-17.

The end caps 2026, 2030 may be coupled to the housing 2014 before or after the lens 2022 is coupled to the housing 2014. In the illustrated embodiment, a width of the side wall 2086 is narrower than a width of the housing 2014 and the lens 2022. The housing 2014 and the lens 2022 slide over the end caps 2026, 2030 so that the side wall 2086 is received within the channel 2042 of the housing 2014 and within the passage 2054 of the lens 2022. The first portion **2086*a* slides along an inner surface of the side portions 2034 (i.e., proximate the channel 2042). As shown in FIG. 17, the protuberances 2150 slide against inner surfaces of the protuberances 2040 (i.e., along a pocket adjacent the channel 2042 that mirrors the shape of the protuberance 2040) and the pockets 2154** slide against inner surfaces of the pockets 2039 (i.e., along a projection adjacent the channel 2042 that mirrors the shape of the pocket 2039). The protuberances 2050 and the pockets 2054 limit movement in directions that are non-parallel to a longitudinal axis 2018 (FIG. 14) of the luminaire 2010, while still allowing translational movement in one direction along the axis 2018. Positioning the side wall 2086 within the channel 2042 and the passageway 2054 allows the lens 2022 to be removed without first requiring removal of the end caps 2026, 2030.

Figure 18:
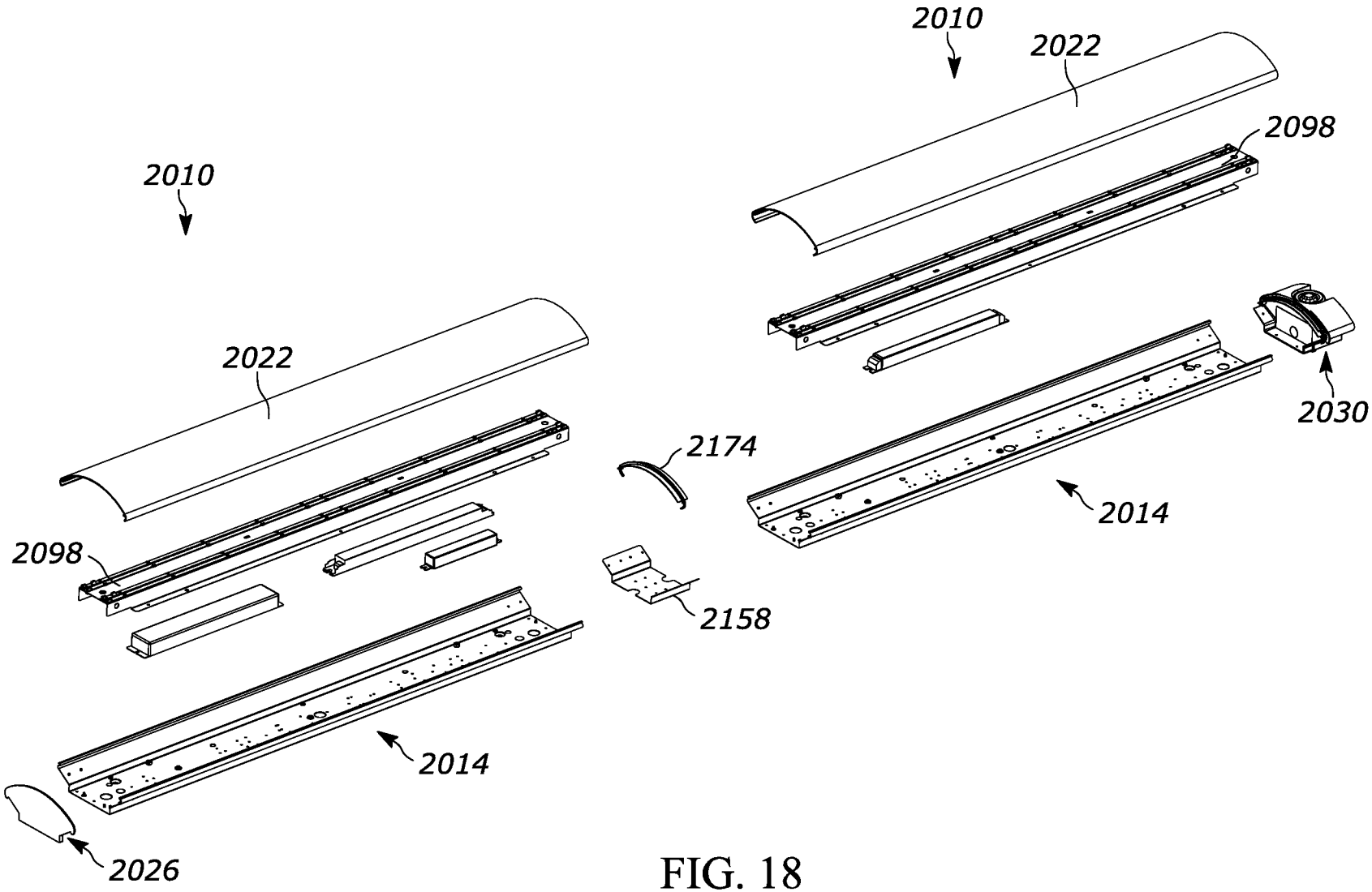
FIG. 18 is an exploded view of two luminaires of FIG. 14 coupled together.

As shown in FIG. 18, multiple housings 2014 may be connected together in an end-to-end manner and provide the appearance of a single elongated housing. To connect two housings 2014, a coupler bracket 2158 is positioned within the channel 2042 against the base portion 2038, overlapping both of the housings 2014. A lens bracket 2174 is coupled to both housings 2014 between the lenses 2022.

Figure 19:
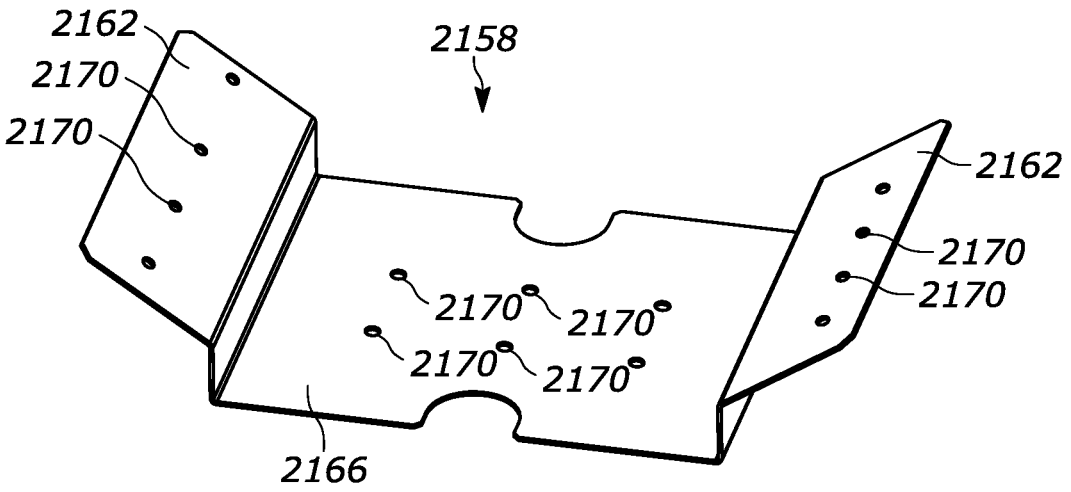
FIG. 19 is a perspective view of a coupler bracket.

As shown in FIG. 19, the coupler bracket 2158 includes two inclined side portions 2162 and a base portion 2166 that extends between the side portions 2162. The cross section of the coupler bracket 2158 has a profile substantially similar to the profile of the housing 2014. The inclined portions 2162 engage the inclined portions 2034 of an end portion of each of the housings 2014. The coupler bracket 2158 includes holes 2170 spaced apart along the base portion 2166 and the side portions 2162. The holes 2170 receive fasteners (e.g., threaded screws—not shown) and couple each housing 2014 to the coupler bracket 2158. Positioning the coupler bracket 2158 within the channel 2042 so that the base portion 2166 of the coupler bracket 2158 contacts the base portion 2038 of each housing provides a smooth engagement surface between the housings 2014.

Figure 20:
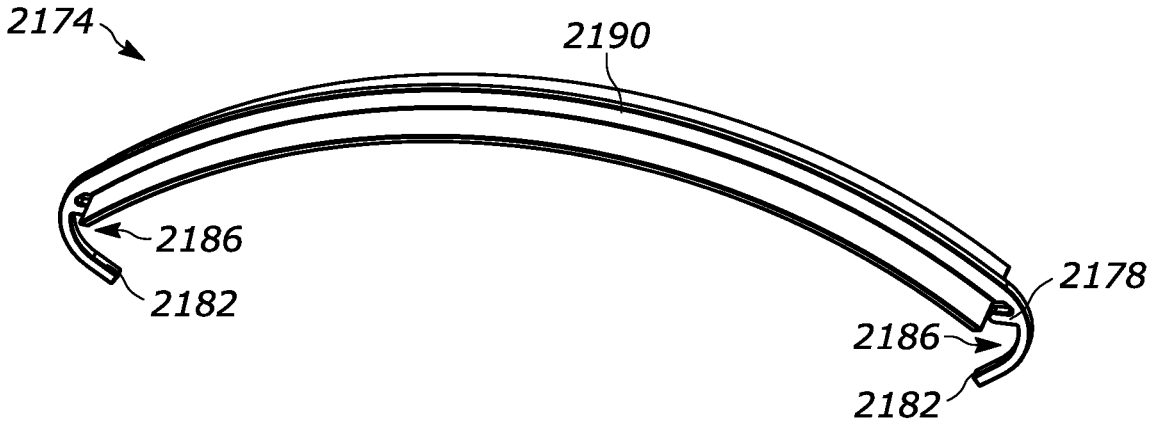
FIG. 20 is a perspective view of a lens bracket.

As shown in FIG. 20, the lens bracket 2174 includes projections 2178, curved portions 2182, and pockets 2186 similar to the projections 70, curved portions 74, and pockets 78 described with respect to FIG. 4, and the lens bracket 2174 is coupled to the housings 2014 in a similar manner as the lens 2022. The lens bracket 2174 also includes a rib 2190. The lens bracket 2174 is positioned between the two lenses 2022 so that each lens 2022 contacts one side of the rib 2190. The lens bracket 2174 and substantially prevents light from escaping at an interface or gap between the lenses 2022.

Figure 21:
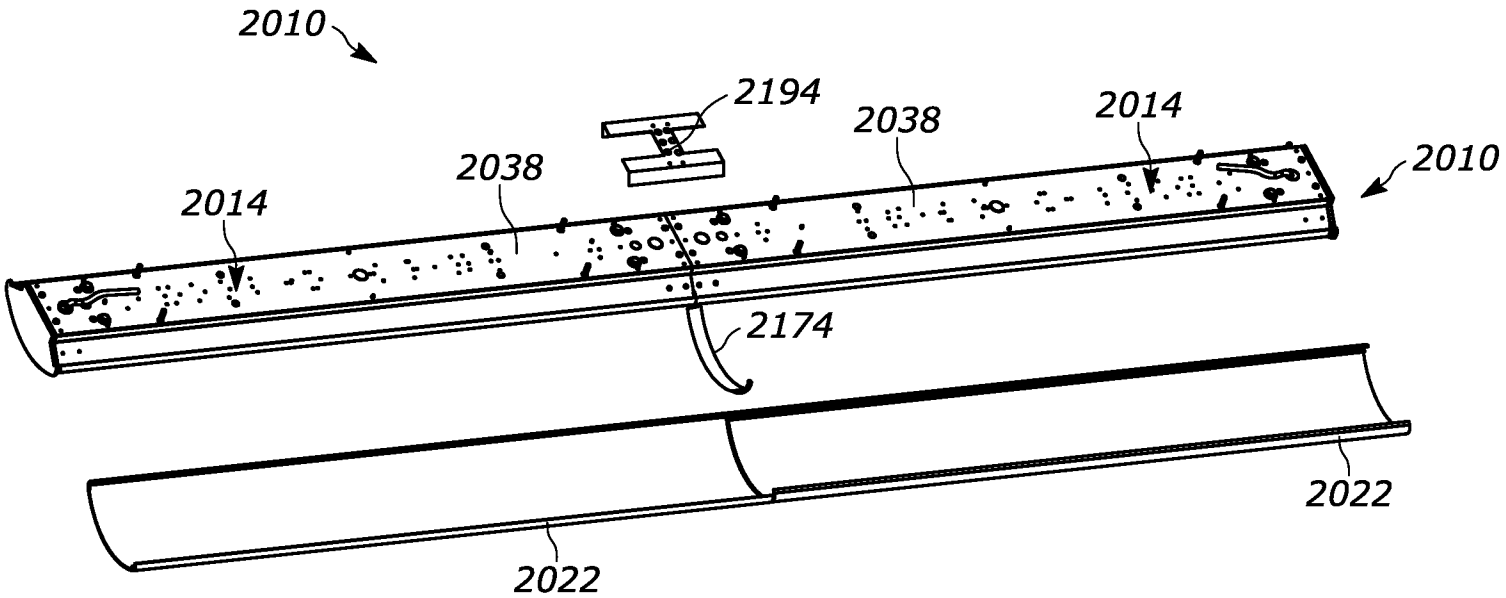
FIG. 21 is a perspective view of a luminaire according to another embodiment.
Figure 22A:
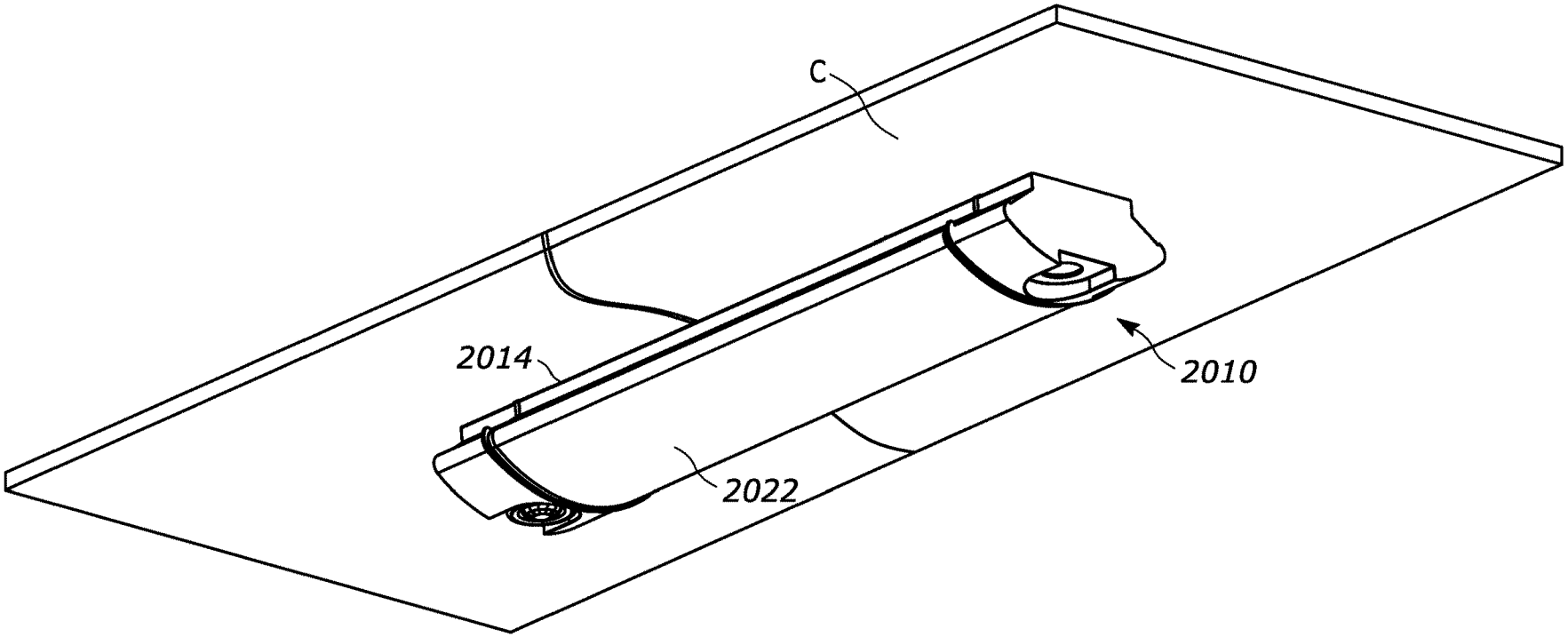
FIG. 22A is a perspective view of the luminaire of FIG. 14 coupled to a ceiling using a first attachment mechanism.
Figure 22B:
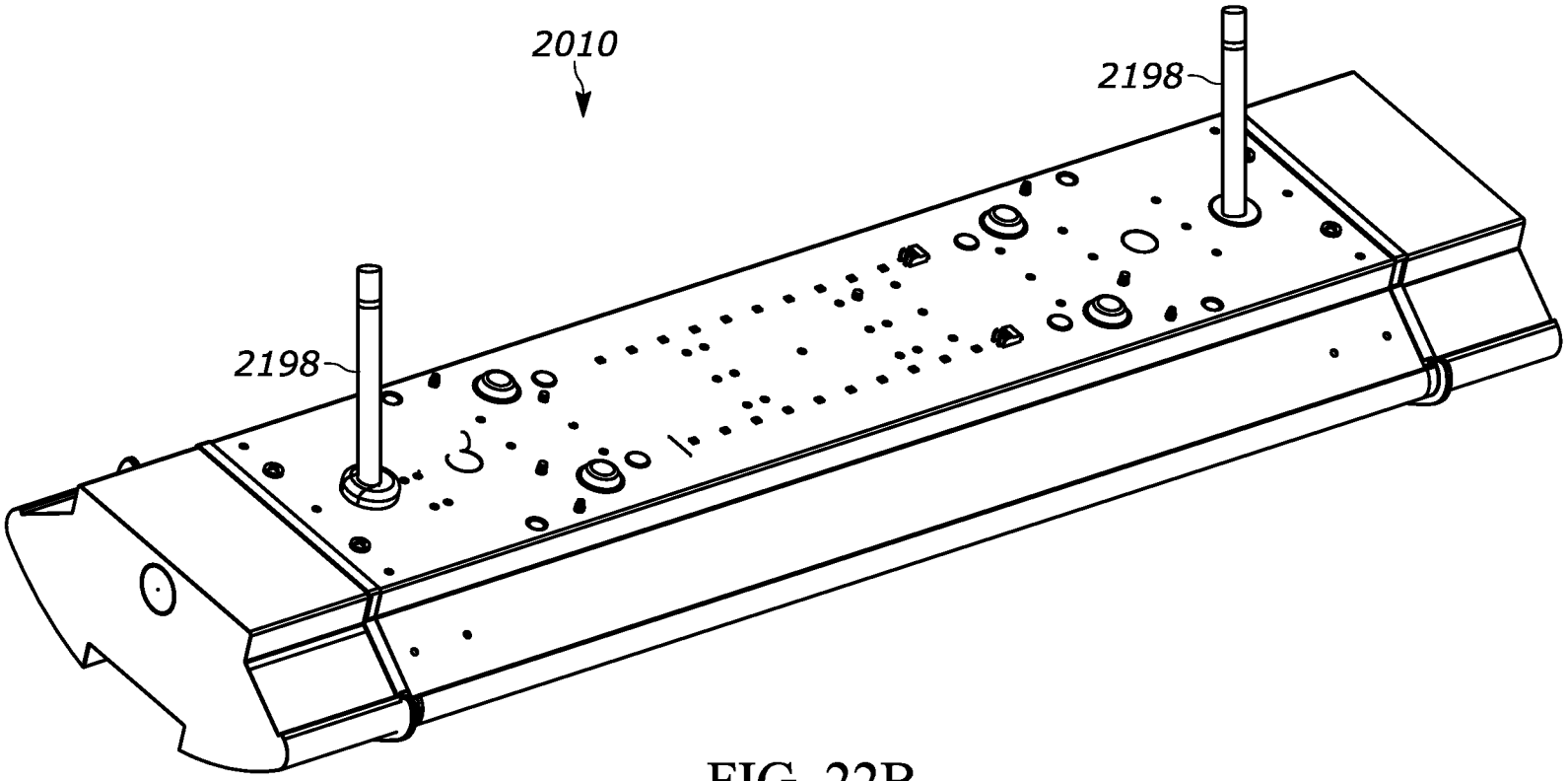
FIG. 22B is a perspective view of the luminaire of FIG. 14 including a second attachment mechanism.
Figure 22C:
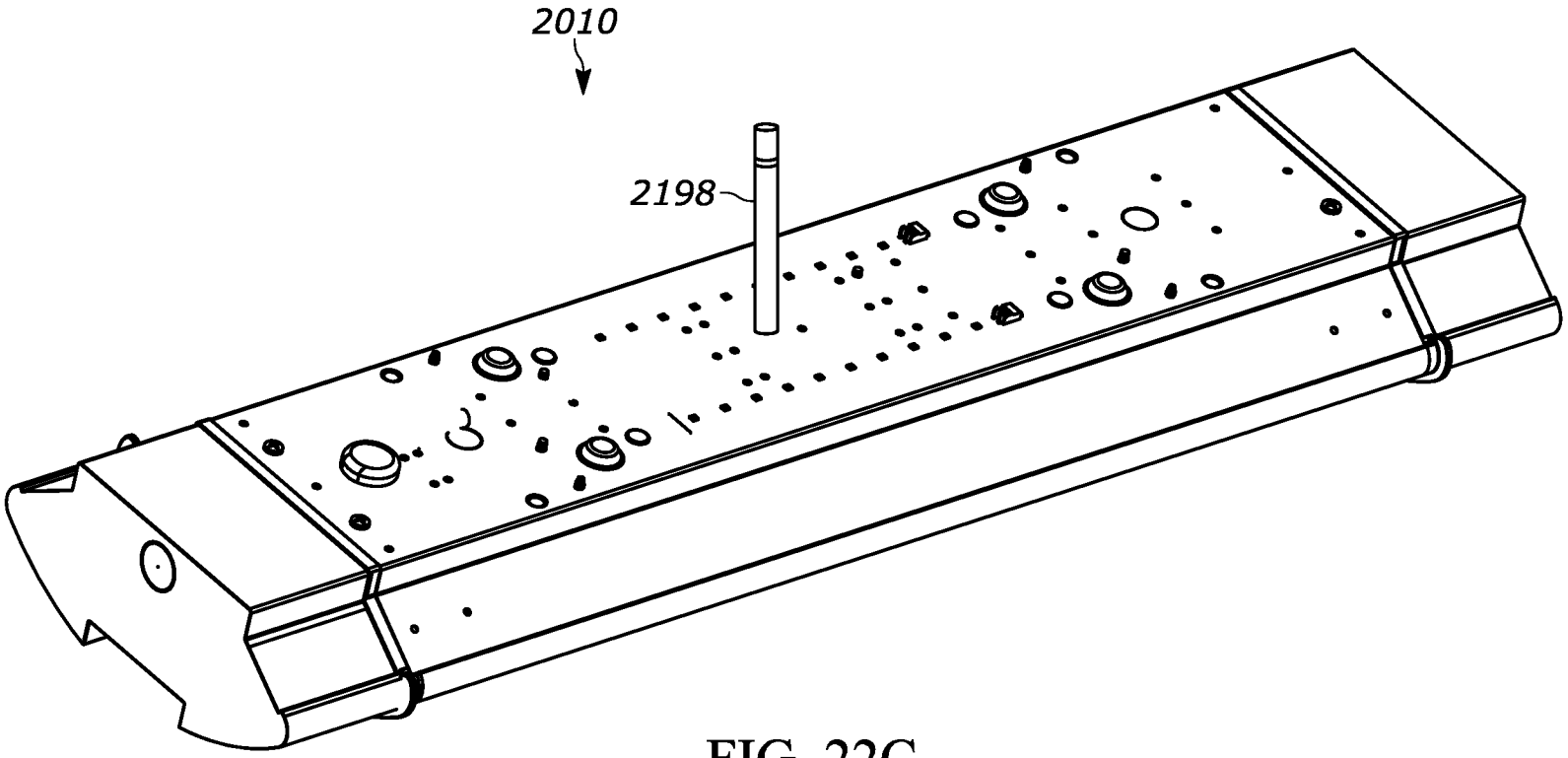
FIG. 22C is a perspective view of the luminaire of FIG. 14 including a third attachment mechanism.
Figure 22D:
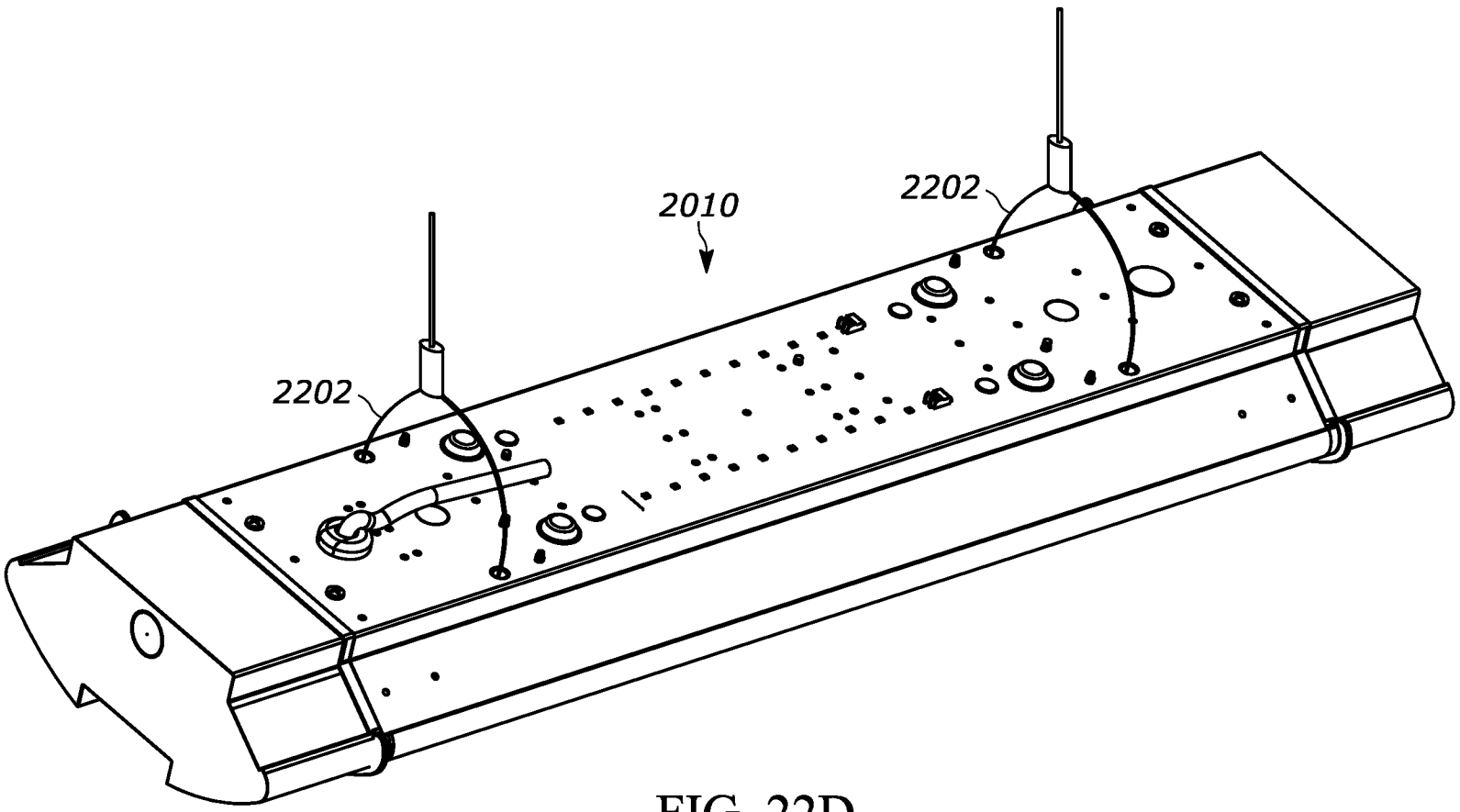
FIG. 22D is a perspective view of the luminaire of FIG. 14 including a fourth attachment mechanism.
Figure 22E:
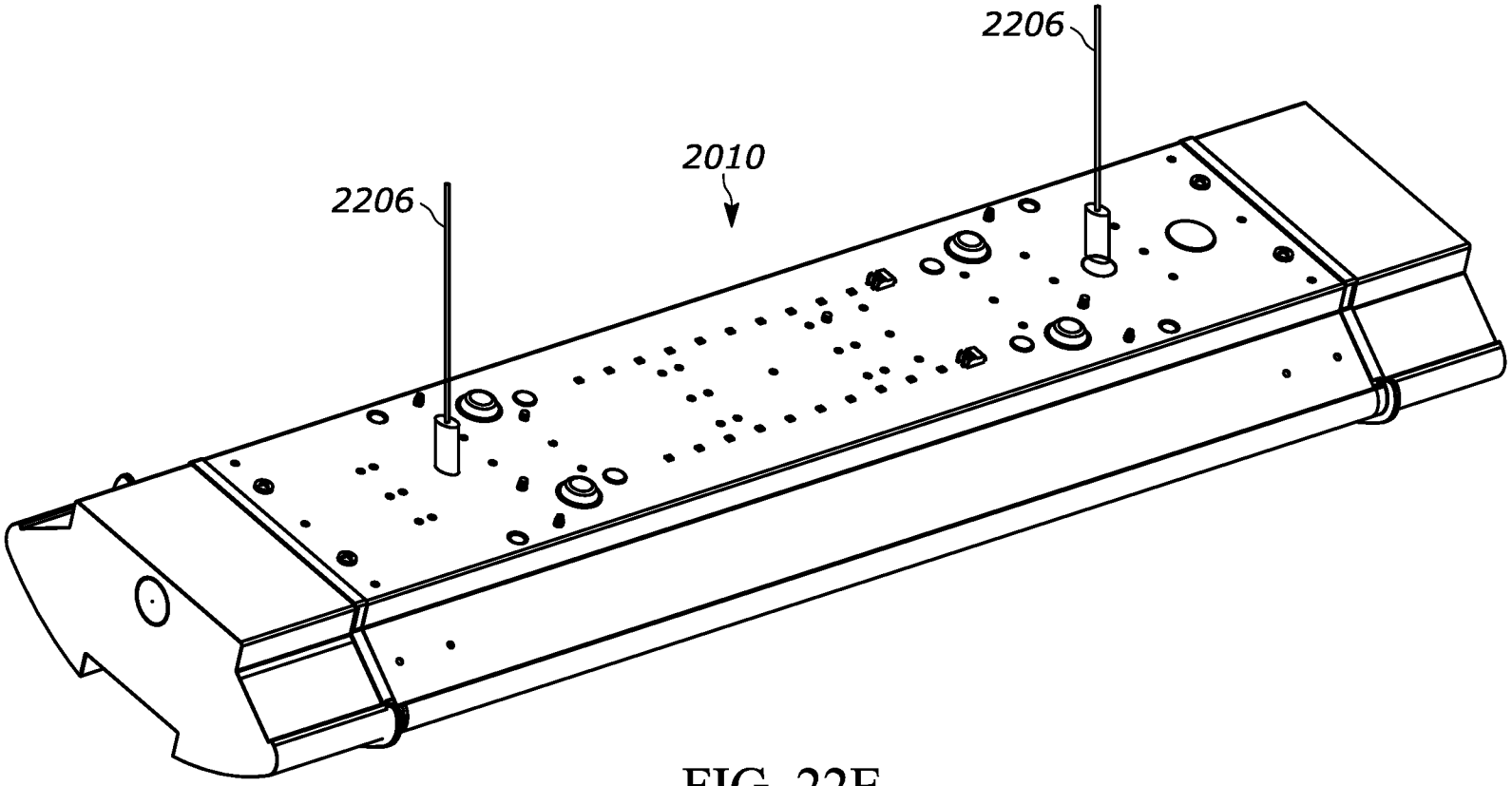
FIG. 22E is a perspective view of the luminaire of FIG. 14 including a fifth attachment mechanism.

As shown in FIG. 21, multiple housings 2014 can be connected together in an end-to-end manner using a coupler bracket 2194 that is positioned against an outer surface of the base portion 2038, overlapping both of the housings 2014. The cross section of the coupler bracket 2194 has a profile substantially similar to an outer profile of each housing 2014. The coupler bracket 2194 can be coupled to the housings 214 using fasteners (e.g., threaded screws—not shown). A lens bracket 2174 is coupled to both housings 2014 between the lenses 2022. The coupler bracket 2194 is removable from the housings 2014 independently of the lenses 2022 (i.e., the lenses 2022 can remain coupled to the housings 2014 while the housings 2014 are uncoupled from each other).

As shown in FIGS. 22A-22E, the luminaire 2010 including a variety of coupling mechanisms that can be used to secure the luminaire 2010 to a ceiling C. For example the luminaire 2010 may be secured directly to the ceiling C with fasteners (not shown) so that the base portion 2038 of the housing 2014 is proximate to, or in contact with the ceiling (see e.g., FIG. 22A). The luminaire 2010 may also be spaced away from the ceiling C. In some embodiments, posts 2198 may be coupled to either end of the luminaire 2010 (see e.g., FIG. 22B), or may be coupled to a center of the luminaire 2010 (see e.g., FIG. 22C). In other embodiments, cables 2202 may be coupled to longitudinal edges of the luminaire 2010 (see e.g., FIG. 22D), or may be coupled along a central axis of the luminaire 2010 (see e.g., FIG. 22E). Although not shown, the luminaire 10 and the luminaire 1010 may be coupled to the ceiling C in any of these ways.

Figure 23:
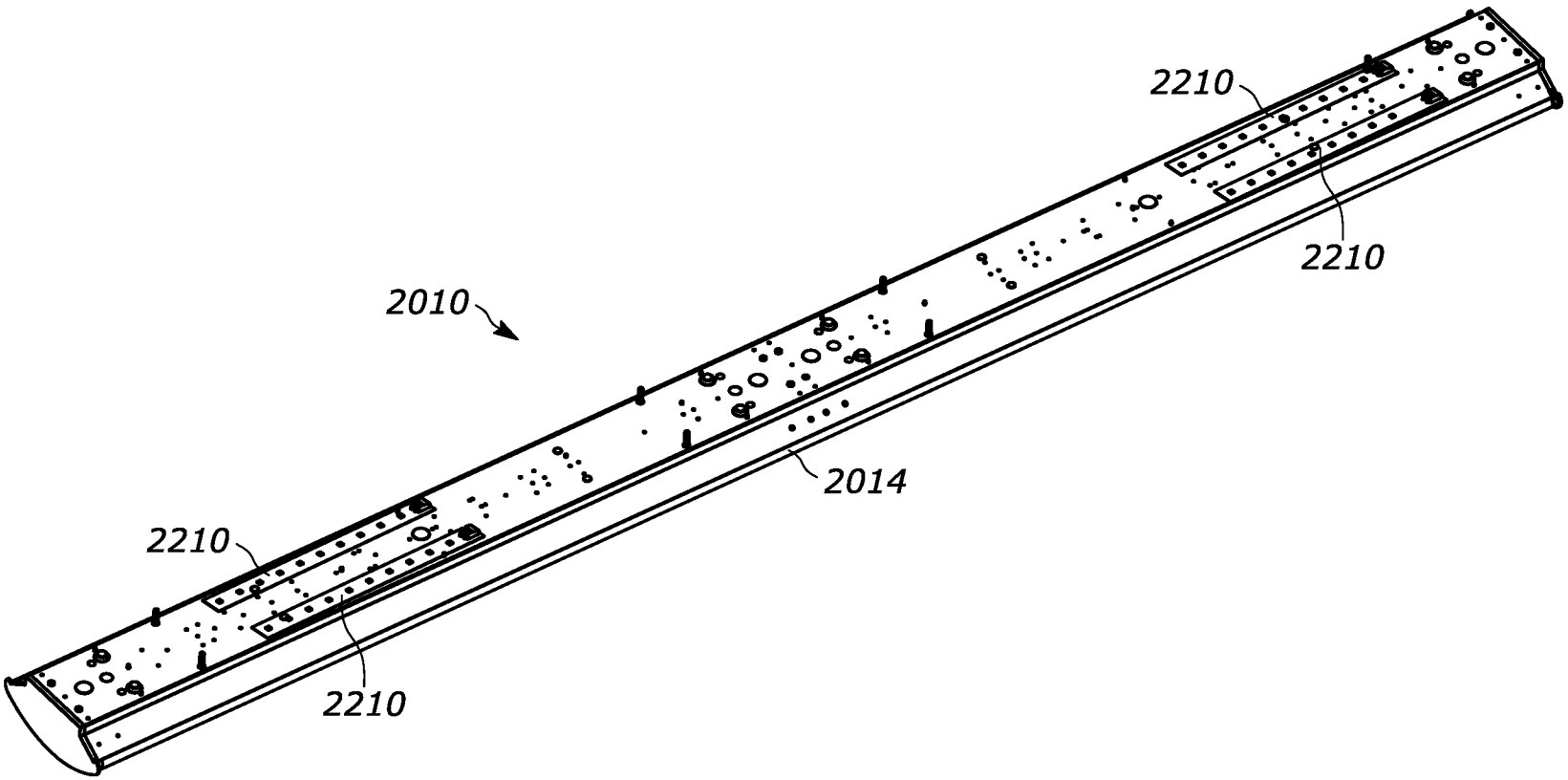
FIG. 23 is a perspective view of the luminaire of FIG. 14 including uplights.

As shown in FIG. 23, uplights 2210 are coupled to the base portion 2038 of the luminaire 2010. The uplights 2210 direct light in a substantially opposite direction relative to the light boards 2114. In the illustrated embodiment, four uplights 2210 are coupled to the base portion 2038, and each uplight 2210 includes at least one LED. The uplights 2210 may be specifically incorporated into the embodiments of FIGS. 22B-22E, where the base portion 2038 is spaced from the ceiling C. The uplights 2210 assist in preventing shadows from forming above the luminaire 2010.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. A luminaire comprising:
- a housing including a pair of sides and a base extending between the sides;
- a lens removably coupled to the housing, the lens including side portions;
- a mounting bracket directly coupled to the base and including a chamber, a driver coupled to the base and positioned within the chamber;
- a plurality of light emitters coupled to a surface of the mounting bracket and in communication with the driver;
- a first portion including a pocket and a protuberance positioned on either a side portion of the lens or a side of the housing; and
- a second portion including a projection and a curved portion positioned on the other of the side portion of the lens or the side of the housing, the protuberance engageable with the pocket to couple the lens to the housing.

2. The luminaire of claim 1, wherein the sides include the first portion having both a pocket and a protuberance and having an S-shape.

3. The luminaire of claim 1, further comprising an end cap coupled to the housing, the end cap configured to limit light emitted from the light emitter from passing through the end cap.

4. The luminaire of claim 3, wherein the end cap includes projections, the end cap slidably coupled to the housing and the projections engage the sides.

5. The luminaire of claim 4, wherein projections of the end cap engage an inner surface of the protuberance.

6. The luminaire of claim 1, wherein the lens includes a curvilinear profile.

7. The luminaire of claim 1, further comprising a sensor configured to sense a signal, which determines a light output from the light emitters.

8. The luminaire of claim 1, wherein the lens and the housing are coupled together with a snap-fit.

9. A luminaire comprising,
- a housing including a pair of sides having an S-shaped portion that includes a pocket and a protuberance;
- a mounting bracket coupled to the housing and including a surface supporting at least one light emitter; and a lens removably coupled to the housing, the lens including side portions having a portion including a projection and a curved portion, the curved portion engageable with the protuberance and the projection engageable with the pocket to create a snap-fit engagement.

10. The luminaire of claim 9, further comprising an end cap coupled to the housing, the end cap configured to limit light emitted from a light emitter of the luminaire from passing through the end cap.

11. The luminaire of claim 10, wherein the end cap includes projections, the end cap slidably coupled to the housing and the projections engaging the sides.

12. The luminaire of claim 11, wherein the projections of the end cap engage an inner surface of the protuberance.

13. The luminaire of claim 9, wherein the lens includes a curvilinear profile.

14. The luminaire of claim 9, wherein the housing further includes a base extending between the pair of sides, the mounting bracket coupled to the base and including a chamber, and a driver coupled to the base within the chamber.

15. The luminaire of claim 9, further comprising a sensor configured to sense a signal, which determines a light output from the light emitters.

16. The luminaire of claim 9, wherein the housing further includes a base extending between the pair of sides and an axis extending along the base, the pocket extending in an orthogonal direction with respect to the axis.

17. The luminaire of claim 9, wherein the housing further includes a base between the pair of sides, the pair of sides inclined with respect to the base.

18. A luminaire comprising, a housing including a base and a first side and a second side extending from the base;

a mounting bracket directly coupled to the base and including a chamber, a driver coupled to the base within the chamber;

a plurality of light emitters supported on a surface of the mounting bracket;

an end cap coupled to the housing, the end cap configured to limit light emitted from the light emitters from passing through the end cap; and a lens removably coupled to the housing at a terminal end of the housing without the use of additional fastening members, the lens configured to at least partially cover the light emitter.

19. The luminaire of claim 18, wherein the sides include an S-shaped portion that includes a pocket and a protuberance and the lens includes side portions having a projection and a curved portion, the S-shaped portion positioned at the terminal end of the housing, and the curved portion engageable with the protuberance and the projection engageable with the pocket to couple the lens to the housing.

20. The luminaire of claim 18, wherein the end cap includes projections, the end cap slidably coupled to the housing and the projections engaging the sides.

21. The luminaire of claim 18, wherein the lens includes a curvilinear profile.

* * * * *